United States Patent [19]

Harada

[11] Patent Number: 5,058,665

[45] Date of Patent: Oct. 22, 1991

[54] STACKED-PLATE TYPE HEAT EXCHANGER

[75] Inventor: Shintaro Harada, Aichi, Japan

[73] Assignee: Aisin Seiki Kabushiki Kaisha, Kariya, Japan

[21] Appl. No.: 498,688

[22] Filed: Mar. 26, 1990

[30] Foreign Application Priority Data

Mar. 28, 1989 [JP] Japan ..... 1-035652[U]
Mar. 29, 1989 [JP] Japan ..... 1-035811[U]

[51] Int. Cl.[5] ..... F28F 7/00; F28F 3/08

[52] U.S. Cl. ..... 165/164; 165/165; 165/908; 165/166

[58] Field of Search ..... 165/154, 164, 165, 166, 165/908

[56] References Cited

U.S. PATENT DOCUMENTS 3,397,738 8/1968 Daunt ..... 165/10
3,477,504 11/1969 Colyer et al. ..... 165/165
3,534,813 10/1970 Fleming ..... 165/164

*Primary Examiner*—Albert W. Davis, Jr.
*Attorney, Agent, or Firm*—Burns, Doane, Swecker & Mathis

[57] ABSTRACT

A stacked-plate type heat exchanger is provided in which each of the plates are provided with holes or openings to facilitate the flow of hot and cold fluids therethrough. The plates are separated from one another by spacers of a predetermined thickness. A pair of fluid passages are defined with respect to the spacers as passing through the plates due to the holes or openings provided therethrough. A first distance between any two of the holes in one plate is a constant value and a second distance between any two of the holes in a second plate is a constant value. Each distance between any one of the holes in the first plate and each of the holes in the second plate which is closest thereto is also a constant value. This arrangement increases the efficiency of heat exchange and decreases the loss of pressure.

8 Claims, 2 Drawing Sheets

STACKED-PLATE TYPE HEAT EXCHANGER

BACKGROUND OF THE INVENTION

1. Field of the Invention

The present invention relates to a stacked-plate type heat exchanger and in particular to a heat exchanger of the type for use in a refrigerator in which helium is used as refrigerant.

2. Description of the Related Art

In FIG. 5, there is illustrated a conventional stacked-plate type heat exchanger disclosed in Japanese Utility Model Publication No. 63-50618. This conventional heat exchanger includes plural plates 1 each of which is provided therein with a plurality of holes 3. Each plate 1 is made of a material having a high thermal conductivity, such as aluminum. Between two adjacent plates 1, a spacer 2 is interposed which is made of a material having a low thermal conductivity such as plastic. With respect to spacers 2, which are in alignment in the vertical direction, plural passages through which hot fluid or gas A flows and plural passages through which cold fluid or gas B flows are defined at a left side and a right side, respectively. In this heat exchanger, at each plate 1, heat exchange is performed between hot fluid A and cold fluid B.

In the above-mentioned heat exchanger, plural passages of one plate are in alignment with those of the adjacent plate. Due to this construction, each fluid or gas does not necessarily flow along or across the overall surface of each plate. In view of the roughness of the surface of each plate, as a whole, the efficiency in heat exchanging is not very good in addition to a loss of pressure.

SUMMARY OF THE INVENTION

It is, therefore, a principal object of the present invention to provide a stacked-plate type heat exchanger without the foregoing drawbacks.

In order to attain this object, a stacked-plate type heat exchanger is provided with a plurality of plates including a plurality of stacked plates, each of which has a first plate provided with a first plurality of holes and a second plate provided with a second plurality of holes. A plurality of spacers is interposed between the first and second plates both of which are in adjacent relationship. A pair of fluid-passages are defined in the plates so that a first pitch or distance between any two of the first holes is a constant value, a second pitch or distance between any two of the second holes is a constant value and each distance between any one of the first holes and each of the plurality of second holes which is closest thereto is also a constant value.

BRIEF DESCRIPTION OF THE DRAWINGS

Additional objects and advantages of the present invention will become more apparent from the following detailed description of a preferred embodiment thereof when considered with reference to the attached drawings, in which.

DETAILED DESCRIPTION OF A PREFERRED EMBODIMENT

Figure 1:
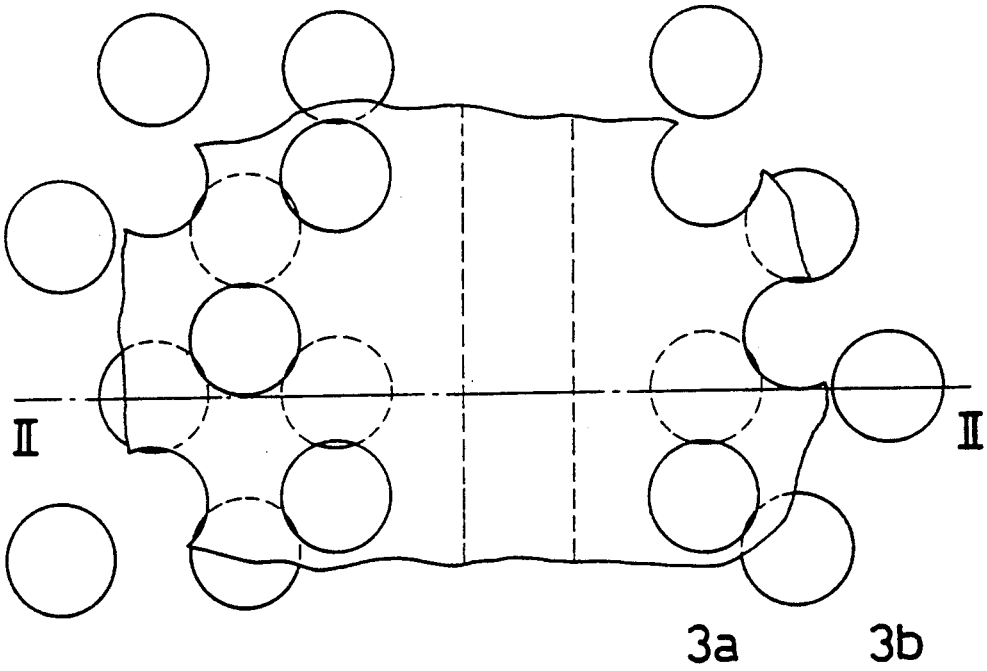
FIG. 1 is a partial horizontal cross-sectional view of a stacked-plate type heat exchanger according to the present invention.
Figure 2:
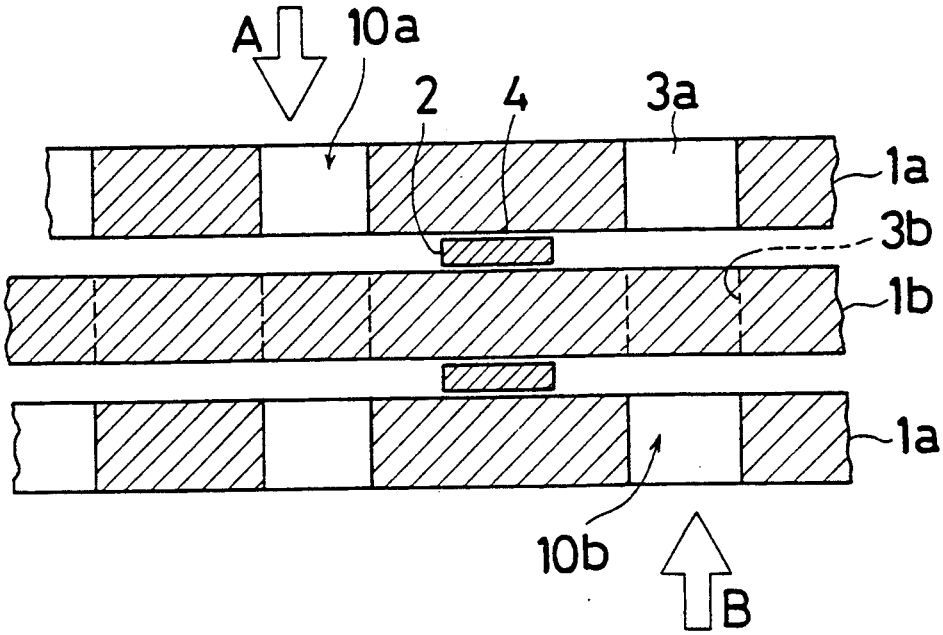
FIG. 2 is a vertical cross-sectional view taken along line II—II in FIG. 1.
Figure 4:
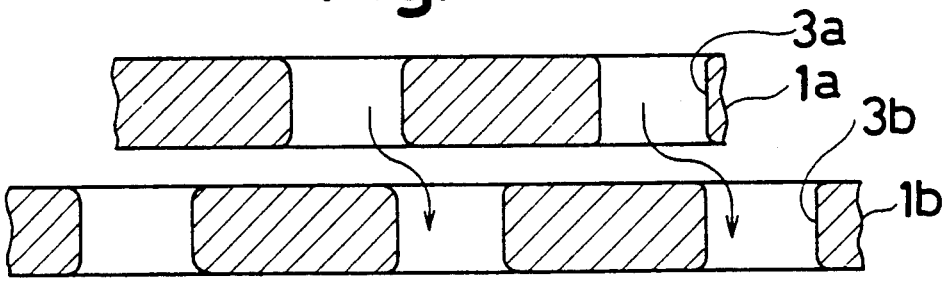
FIG. 4 is a vertical cross-sectional view taken along line IV—IV in FIG. 3.
Figure 5:
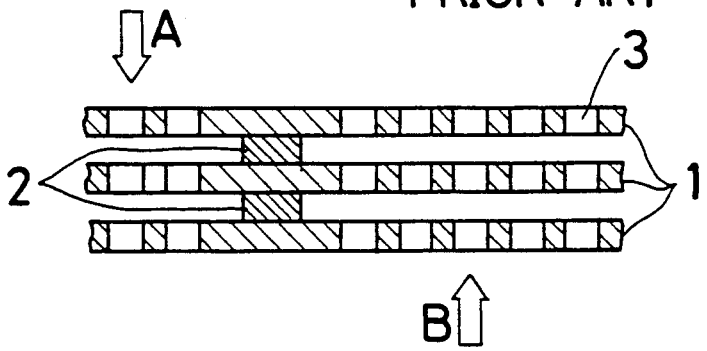
Fig. 5 PRIOR ART
FIG. 5 is a vertical cross-sectional view of a heat exchanger of prior art.

Referring now to FIGS. 1 and 2, a first plate 1*a* and a second plate 1*b* are arranged in the vertical direction between which a spacer 2 is interposed. Each plate 1*a*, 1*b* is made of a material having high thermal conductivity, such as copper, and has a thickness of substantially 0.4 mm. The spacer 2 is made of a material having low thermal conductivity, such as stainless steel, and is connected to the both plates 1*a* and 1*b* by a cement or adhesive 4. A gap of about 0.125 mm is set between both plates 1*a* and 1*b*. In the first plate 1*a*, there are formed a plurality of regularly arranged holes or openings 3*a* each of which has a diameter of about 0.5 mm. Similarly, holes or openings 3*b* are formed in the second plate 1*b* each of which has a diameter of about 0.5 mm. As best shown in FIG. 4, an edge of each hole 3*a*, 3*b* is chamfered. A first fluid-passage 10*a* and a second fluid passage 10*b* are formed at a left side and a right side, respectively, with respect to each spacer 2. While hot fluid A and cold fluid B are flowing through the first passage 10*a* and the second fluid passage 10*b*, respectively, the heat exchange function is performed at each plate 1*a*, 1*b*. It should be noted that "cold fluid" means only that the fluid B is lower in temperature than the hot fluid.

Figure 3:
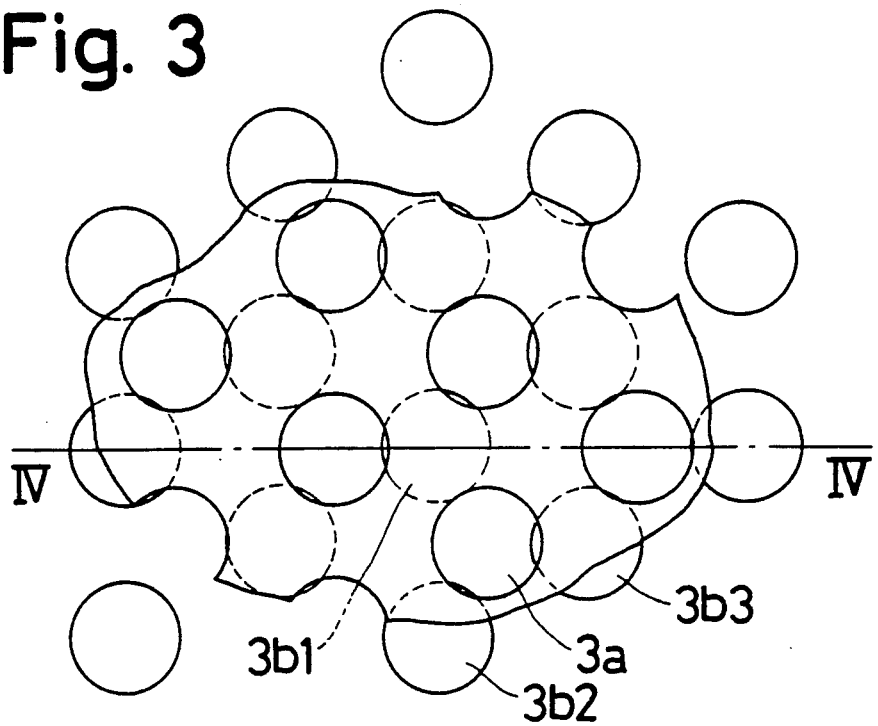
FIG. 3 is an enlarged horizontal cross-sectional view of a heat exchanger in FIG. 1.

As shown in FIG. 3 and 4, a pitch or distance between the centerlines of any two holes 3*a*, 3*b* is set to be about 0.5 mm. The pitch between the holes 3*a* and 3*b*1, the pitch between the holes 3*a* and 3*b*2, and the pitch between the holes 3*a* and 3*b*3 are equal to one another. The holes 3*b*1, 3*b*2 and 3*b*3 are closer to the hole 3*a* than any of the other holes or passages in the plate 1*b*.

When a hot fluid A or cold fluid B flows into holes 3*b* of the second plate 1*b* after passing through the holes 3*a* of the first plate 1*a* at a predetermined flow rate, hot fluid A or cold fluid B is equally divided and each of the resulting fluid flows passes through the openings 3*b*1, 3*b*2, and 3*b*3. Also, the cross-sectional area of each fluid A, B is not substantially changed even though each hole 3*a* is not in alignment with a corresponding hole 3*b*. Thus, no change occurs in each of the fluid flows and constant distribution of the fluid flow can be obtained. This means that overall surface of each plate 1*a*, 1*b* contributes to the heat exchange, thereby increasing efficiency of the heat exchange function and reducing loss of pressure. In addition, the chamfer of the edges of each hole promotes reduction in the loss of pressure.

It should be noted that the number of plates does not matter as long as the foregoing relationships between holes of both plates 1*a* and 1*b* are maintained.

In addition, according to the present invention, the thickness of the cement or adhesive 4 is predetermined to be less than 0.01 mm (10 microns) and the thickness of the spacer 2 is predetermined to be greater than about ten times the thickness of the cement or adhesive 4. Further, spacer 2 is of a predetermined width which is in the range of 5–20 times the thickness of the spacer 2. Therefore, in this embodiment, each spacer 2 has a thickness of about 0.125 mm and has a width of about 1.0 mm. Each spacer 2 is connected to both plates 1*a* and 1*b* by the cement or adhesive 4 which is made of a nickel soldering flux having a high strength of connection with respect to the thinness of the layer. The cement 4 has a thickness of substantially 0.005 mm (5 microns). Due to the connection of both plates 1*a* and 1*b* by the thin layer of cement, flow of the cement 4 from between spacer 2 and the plates, into the fluid passage 10*a*, 10*b* is prevented. Thereby, a reduction in the gap between both plates is obtained and the width of the spacer 2 is kept small. Accordingly, loss of heat transferred in the axial direction of the spacer is reduced due to small sectional area of the spacer and the efficiency of the heat exchange is improved.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A stacked-plate type heat exchanger comprising:

plate means including a plurality of stacked plates in adjacent relationship, at least a first plate provided with a first plurality of openings and at least a second plate provided with a second plurality of openings;

a plurality of spacers interposed between the first and second plates; and a pair of fluid passages defined with respect to the spacers in the plate means;

wherein a first distance between the centerlines of any two of the first plurality of openings is a constant value, a second distance between the centerlines of any two of the second plurality of openings is a constant value, a distance between any one of the first plurality of openings and each of the second plurality of openings closest to the first plurality of openings is also a constant value and each distance between any one of the first plurality of openings and each of the second plurality of openings closest to the first plurality of openings is the same as the diameter of the openings of each plate.

2. A stacked-plate type heat exchanger according to claim 1, wherein the first plate is made of a material having a high thermal conductivity.

3. A stacked-plate type heat exchanger according to claim 2, wherein the material is copper.

4. A stacked-plate type heat exchanger according to claim 2, wherein the material of high thermal conductivity is copper and the plurality of spacers is made of a material having a low thermal conductivity.

5. A stacked-plate type heat exchanger according to claim 1, wherein the plurality of spacers is made of a material having a low thermal conductivity.

6. A stacked-plate type heat exchanger according to claim 5, wherein the material is stainless steel.

7. A stacked-plate type heat exchanger according to claim 1, wherein the spacers are in alignment with each other.

8. A stacked-plate type heat exchanger according to claim 1, wherein the first plate is made of a material having a high thermal conductivity and the plurality of spacers is made of a material having a low thermal conductivity.

* * * * *